United States Patent [19]

Dupke

[11] Patent Number: 4,604,920

[45] Date of Patent: Aug. 12, 1986

[54] FILTER WRENCH

[76] Inventor: Conrad E. Dupke, 870 Tanglewood Dr., Wheeling, Ill. 60090

[21] Appl. No.: 743,390

[22] Filed: Jun. 11, 1985

[51] Int. Cl.[4] ..... B25B 13/46

[52] U.S. Cl. ..... 81/64

[58] Field of Search ..... 81/64, 3.43; 294/31.2

[56] References Cited

U.S. PATENT DOCUMENTS

| | | | |
|---|---|---|---|
| 274,591 | 3/1883 | Gregg | 81/64 |
| 1,976,623 | 10/1934 | Monroe et al. | 81/64 |
| 2,325,841 | 8/1943 | Faber | 294/31.2 |
| 4,007,650 | 2/1977 | Wellman | 81/64 |

*Primary Examiner*—James L. Jones, Jr.

*Attorney, Agent, or Firm*—Paul H. Gallagher

[57] ABSTRACT

A band or ring, split at one point in its circumference, forming end portions directed toward each other. A pair of handles are welded to the band, at the end portions, each at points distributed over substantial length of the band. The band is of work hardened steel, and knurled on its inner surface. The steel band is self-biased to an outer or enlarged size, and contractible to an inner or smaller size by squeezing on the handles, for gripping an object.

8 Claims, 7 Drawing Figures

FILTER WRENCH

FIELD OF THE INVENTION

The invention resides in what are known as filter wrenches. Such a wrench includes a band that is contracted on an object for gripping it, and is included in the broad classification of band wrenches.

OBJECTS OF THE INVENTION

A broad object of the invention is to provide a filter wrench having the following features and advantages:

1. It is extremely strong for maintaining true shape.
2. It is of special design such that even with its great strength, it is applied to the object to be gripped without distorting the object, notwithstanding the thin casing of the object such as in an automobile oil filter.
3. It is of convenient size for holding in one hand and inserting it in cramped places.
4. It assumes a self-biased enlarged shape, facilitating its placement on an object, and manipulating it in gripping the object, and releasing it for obtaining a new grip.

DESCRIPTION OF A PREFERRED EMBODIMENT

The wrench of the present invention is of the kind generally known as a filter wrench. It is in the broad field of a band wrench, but the use of the device as a filter wrench constitutes a very large portion of the overall use of such wrenches, that it has come to be known by that name. However it is not limited to that kind of use but may be used in connection with any other object which is to be clamped and which is dimensioned for clamping by the wrench. A particular phenomenon found in the case of filters, and the wrenches to be used therewith, is that a filter casing is usually very thin, or of small gauge, and when a wrench is applied thereto, the danger is great that the casing will buckle, or be bent. This situation exists most commonly in the case where a wrench, i.e., a band wrench, does not completely encircle the object, such as a filter casing, leaving gaps or small areas which are not directly gripped by the band of the wrench. In these areas buckling or misshaping most often takes place. The wrench of the present invention includes a band that completely encircles the object, or filter casing, leaving no gaps in which the wrench does not engage the casing, and as a consequence the band exerts pressure inwardly, generally radially, on all points of the filter casing, and as a result the casing is not bent or otherwise misshapen. In this situation, the band of the filter wrench can be made extremely strong, and in the present case it is so made strong, so that the band itself does not become misshapen, but exerts the intended pressure at all points around the filter casing, assuring the intended uniform gripping of the band on the casing. Thus the band is made of heavy gauge material, to provide the desired strength, while on the other hand the filter casing can be made very thin, or of small gauge, and the casing will be gripped by the band in all cases in proper fashion.

Referring in detail to the drawings, the filter wrench of the invention is indicated in its entirety at 10 and includes a band 12 and a pair of handles 14 which are identical in construction, and oppositely and symmetrically arranged in the wrench.

Figure 2:
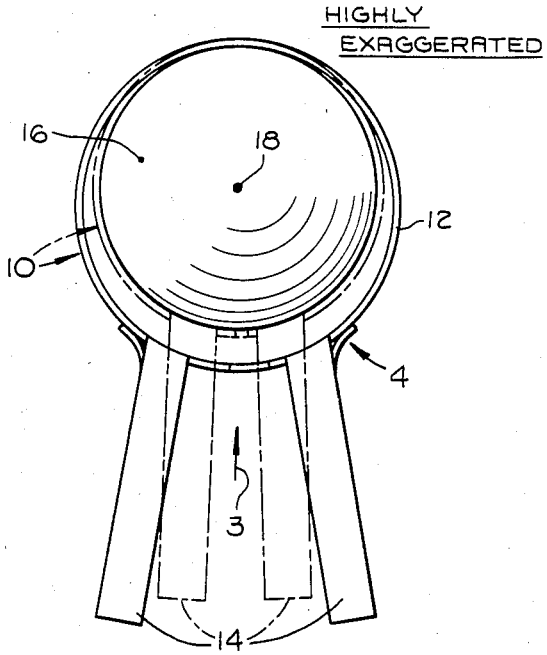
FIG. 2 is an axial view of the wrench applied to an object, and showing the wrench in expanded and contracted positions.

FIG. 2 shows the wrench applied to an object 16 to be manipulated, in this case an oil filter for an automobile. The band 12 is of near-circle shape, and when tightened on a circular object, such as the oil filter 14, will assume substantially that circular shape. For purposes of convenience, the central axis of the oil filter is indicated at 18 and this axis is utilized in the following description in association with the band 12 for orientation of the wrench; when the band is tightened on the filter, it is substantially concentric therewith, but when the band is loosened, it assumes a larger size and is not accurately concentric with that axis, although for convenience in referring to the wrench, it will be considered as being concentric. In a similar manner, the handles 14 may be referred to as radial, being near-radial in position.

For convenience in describing the device, and its utilization, one example of dimensions thereof may be as follows. A very common size, and the most common size, of oil filters 16, is 3 11/16" in diameter.

The band 12 may be referred to as circumferential. It is non-continuous, having a cut 20, forming end portions 22 directed toward each other, the band being otherwise continuous. The cut 20 is at an angle indicated at 24 (FIG. 3) at an acute angle to the axis 18, when viewed in radial direction, forming points 26, individually identified *26a* and *26b*, which overlap in circumferential direction, as will be referred to again hereinbelow.

The band 12 is made of steel, and in the size of wrench referred to above, is preferably on the order of ½" wide, in axial direction, and ⅛" thick, in radial direction. The steel is work hardened to a spring temper. It is self-biased in outward direction, to a large size shown in full line position in FIG. 2, and is contractable to an inner and gripping position shown in dot-dash lines in that figure.

Figure 1:
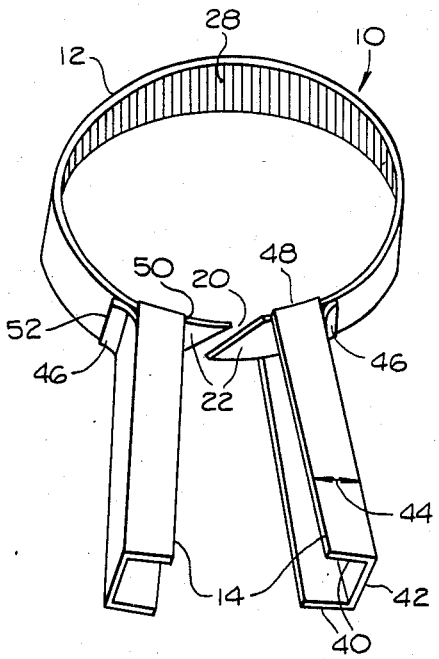
FIG. 1 is a perspective view of the filter wrench of the present invention.
Figure 5:
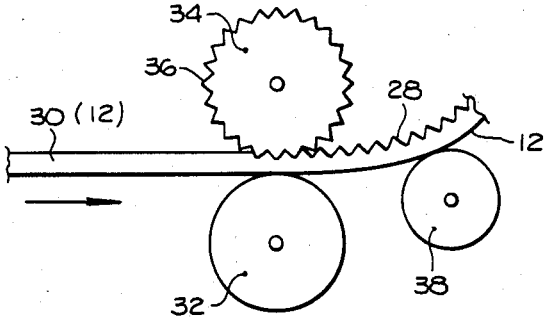
FIG. 5 is a diagrammatic view of forming means for producing the band of the wrench from a straight steel strip.

The band 12 is knurled as indicated at 28 (FIG. 1) with fine ribs running in axial direction. The band is made or shaped in a known manner by known means indicated in FIG. 5. In that figure a strip 30 of the desired steel is fed between rolls 32, 34. One of the rolls, 34, is provided with a ribbed surface 36 which forms the knurling 28 on the strip, and the strip after it leaves the rolls 32, 34, is deflected or bent by another roll 38 which shapes the strip into the desired circumferential shape, to form the band 12.

The handles 14 are of steel, and as indicated above, are identical. In one form of device, each handle is in the form of a channel having flanges 40 and a web 42 and for convenience may be referred to as having a depth in direction from the web 42 to the free edges of the flanges 40, as indicated by the double headed arrow 44 in FIG. 1. At the inner end of the handle, the web 42 is cut from the channels and the extremity thereof bent outwardly, in direction away from the free edges of the flanges, to form a lug or tang 46. The handle is applied to the band by fitting the inner end elements of the flanges, as indicated at 48 on axially opposite edges of the band, and the lug 46 extends generally circumferentially of the band, and is fitted thereagainst at its outer end portion. The handle is then welded to the band at suitable spots, preferably at the spots 50, 52. These two spots are a substantial distance apart, circumferentially of the band, such as on the order of 1" which provides great rigidity and strength. The channel forming the handle is thus rigidly secured to the band and it forms a unitary, and in effect, integral, extension of the band.

In the use of the wrench of the invention, it is held in one hand, by gripping the two handles, and the band fitted over the object to be manipulated. It is dimensioned for use with a predetermined size object so that when it is in self-biased outer, enlarged position, it is slightly larger than the object. In the present case it may be on the order of ⅛" greater, i.e., in diametrical direction. Then the handles are squeezed toward each other, which contracts the band inwardly, into gripping position against the object. The knurling 28 provides positive, non-slip grip. The fine knurling provide ribs of such small size as not to cause denting of the casing of the filter. Normally the manipulation of the object consists in a turning action, such as a threading action, by twisting, or moving the two handles, together as a unit, in a circumferential direction. This turning or twisting action produces a still greater gripping action on the object.

A very important feature of the invention is the particular gripping action of the band on the object. A round or cylindrical shape withstands great pressure when the pressure is uniform therearound, with no pronounced concentration at any point, such as would dent, or buckle, the surface of the object. The thickness and corresponding strength of the band produces this effect. When in its outer position it is not exactly circular, but nearly so, and when it is in inner contracted position, it is substantially circular, concentric with the axis of the object. This same thickness and strength of the band takes effect in the connection between the handles and the band. The handles are welded to the band, each at the two points mentioned above, those two points being of greatly spaced positions in circumferential direction. Accordingly there is substantially no tendency for the handles themselves to produce localized bending of the band at the points of connection between the handles and the band, with the consequence that the squeezing action on the handles produces a continuous and uniform contraction of the band.

Figure 3:
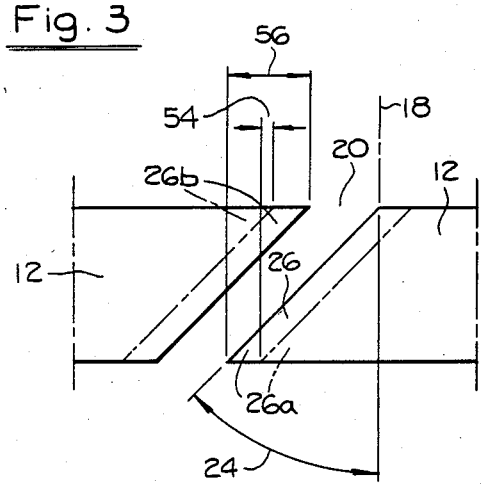
FIG. 3 is a detail view of a fragment of the wrench, taken as indicated by the arrow 3 in FIG. 2.
Figure 4:
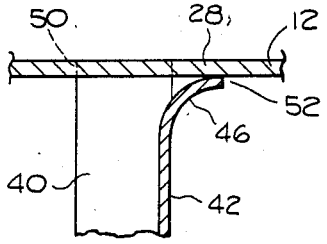
FIG. 4 is a fragmentary sectional view of a portion of the wrench of FIG. 2, at the position indicated at 4, with certain elements in the foreground removed.

The overlapping points 26 of the band produce further action to this effect. The cut 20 is so arranged that the points 26 preferably overlap even in enlarged position, but more so when the band is in contracted position to an extent indicated by the double headed arrow 50 (FIG. 3). Thus the object is completely encircled and there are no gaps whereby the wall of the object would be deflected in a localized area. The end portions 22 extend beyond the handles, avoiding any tendency of the handles to pivot at the points 50, in the gripping action, which otherwise would dent the casing of the object.

The dimensions given above are of course only examples, but particular attention is given to the thickness of the material of the band, such as ⅛"; the material should be at least that thick for the size of tool referred to. The oil filter may be 3 11/16" in diameter, as referred to above, or it may be 3", or 4", etc. It is usually preferable to utilize a different size wrench for each of those different size oil filters. It will be understood that wide ranges are permitted, relative to the specific dimensions mentioned.

The channel shape of the handles provides a great advantage. The web elements are on the outer sides of the handles which are engaged by the hand, and provide a smooth surface. The flanges 40, extending in circumferential direction, provide extremely great strength encountered in the squeezing action.

Figure 6:
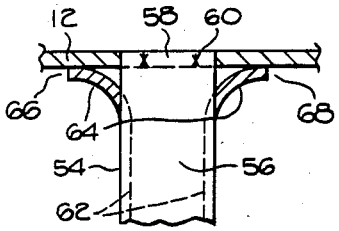
FIG. 6 is a fragmentary view of a modified form.

While the channel shape handle is the preferred form, other forms may be used instead. For example solid metal handles may be used, and another form is tubular handles, such as square in shape. Attention is directed to FIG. 6 which shows a handle 54 secured to the band 12. The handle 24 is of square tubular shape, having opposite side walls 56 of which the end elements 58 are fitted to the axially opposite side edges of the band and secured thereto as by spot welding as indicated at 60. The other two side walls, 62, are cut at the ends, forming lugs 64 which are turned out, and extend generally circumferentially of the band and are secured thereto as by welding at points 66, 68. These lugs 64 extend a substantial distance circumferentially, providing a broad area, in circumferential direction, in which the handle is applied to the band, preventing buckling or bending of the band and consequent denting of the casing of the filter. The handles 54 provide the overall effect in use, as the handles 14, but they are more expensive than the channel form of the handles 14.

Figure 7:
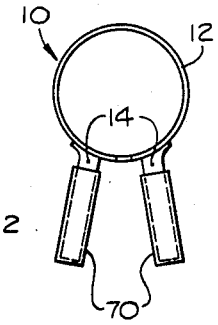
FIG. 7 shows a wrench with electrical insulation coating on the handles.

It is also proposed to apply electrically insulating material to the handle, such as plastic material, as indicated at 70 in FIG. 7, in a known manner, which may be done by merely dipping the handles in the material.

The device can easily be held and manipulated in one hand. An oil filter can be removed, or replaced, in a very small period of time. The device is extremely convenient in places where the space is limited, and this is in great contrast to large size wrenches and particularly those that require two hands for manipulation. In manipulating the object, the wrench is easily worked back and forth, gripping the object while moving it in one direction, and releasing it while moving it in the other direction.

I claim:

1. A filter wrench comprising, a curved band in a near-circle shape, and having an axis, and radial and circumferential directions according to a circle, the band including end portions having end surfaces directed toward each other, and otherwise being continuous from one end to the other, the band being of uniform cross sectional shape between points closely adjacent the end surfaces, and being of uniform thickness throughout, the band being self spring biased to an outer position of large size and capable of being flexed to an inner position of small size, the band being of great thickness whereby in moving between its said positions, the band does not bend in localized areas, but all bending takes place as a continuous and progressive action distributed throughout the length of the band, whereby in said positions, and positions therebetween, the band maintains its near-circle shape, and handles secured to the band at the end portions thereof, and extending generally radially therefrom, the handles being rigid, and capable, when gripped in the hand and moved toward each other in circumferential direction, of contracting the band to its inner position, the handles being rigidly secured to the band each at points spaced apart a substantial distance circumferentially of the band, whereby in response to the handles being moved toward each other, the band is capable of withstanding deformation at the junctures of the handles and the band.

2. A filter wrench according to claim 1 wherein, the handles are channel shape and have flange elements on axially opposite sides of the band, and a web element extending circumferentially beyond the flange elements and engaging the band, and the securement of the handles on the band consist of weld junctures at the edges of the flange elements opposite the web element and at the extremity of the web element.

3. A filter wrench according to claim 1 wherein, the handles are of tubular shape, each having a first pair of wall elements with end elements engaging axially opposite side edges of the band and welded thereto, and a second pair of wall elements with end elements bent outwardly and fitted to the band and extending therealong in generally circumferential directions, and the latter end elements being welded at their outer ends to the band.

4. A band wrench according to claim 1 wherein, the inner surface of the band is provided with knurl elements extending in axial direction, and distributed throughout the length of the band.

5. A band wrench according to claim 1 wherein, the wrench possesses the following proportions, but not limited to the absolute dimensions stated, the band is on the order of 3" in diameter, and the material thereof is hardened steel on the order of ⅛" thick in radial direction.

6. A band wrench according to claim 5 wherein, the handles are of steel, and each welded to the band at points spaced apart a distance of on the order of 1".

7. A filter wrench comprising, a curved band in a near-circle shape, and having an axis, and radial and circumferential directions according to a circle, the band having end portions directed toward each other, and handles secured to the band at the end portions thereof, and extending generally radially therefrom, the band being of rigid material, and being self spring biased to an outer position, the handles being rigid, and rigidly secured to the band, and capable, in response to being moved toward each other in circumferential direction, for contracting the band into an inner position, the band has terminal elements at said end portions that overlap in circumferential direction at least in said inner position of the band.

8. A filter wrench comprising, a curved band in a near-circle shape, and having an axis, and radial and circumferential directions according to a circle, the band having end portions directed toward each other, and handles secured to the band at the end portions thereof, and extending generally radially therefrom, the band being of rigid material, and being self spring biased to an outer position, the handles being rigid, and rigidly secured to the band, and capable, in response to being moved toward each other in circumferential direction, for contracting the band into an inner position, the band has terminal elements at said end portions that overlap in circumferential direction at least in said inner position of the band, said end portions have circumferential end surfaces positioned at an acute angle to said axis, as viewed radially, whereby to provide pointed elements constituting said terminal elements.

* * * * *